United States Patent [19]

Marescalco

[11] 3,949,773

[45] Apr. 13, 1976

[54] CONVERTIBLE TIP FOR CRUTCH OR THE LIKE

[76] Inventor: Anthony E. Marescalco, 5947 Seventh Ave., Apt. M-1, Kenosha, Wis. 53140

[22] Filed: Mar. 10, 1975

[21] Appl. No.: 556,550

[52] U.S. Cl. ..... 135/57; 135/55

[51] Int. Cl.[2] ..... A45B 9/04

[58] Field of Search ..... 135/54, 55, 56, 57

[56] References Cited

UNITED STATES PATENTS

| | | | |
|---|---|---|---|
| 619,235 | 2/1899 | Schwarting | 135/58 |
| 2,116,941 | 5/1938 | Francis | 135/57 |

FOREIGN PATENTS OR APPLICATIONS

| | | | |
|---|---|---|---|
| 694,731 | 7/1940 | Germany | 135/57 |
| 874,724 | 8/1961 | United Kingdom | 135/54 |

*Primary Examiner*—Werner H. Schroeder
*Assistant Examiner*—Conrad L. Berman
*Attorney, Agent, or Firm*—Arthur J. Hansmann

[57] ABSTRACT

A convertible tip for a crutch and the like having a pole and an elastomeric cup-shaped member disposed on the end of the pole for contacting the ground, and a cleat member attachable to the cup-shaped member, by means of a releasable fastener, and another cup-shaped member for covering the cleat, so that the tip is convertible between the arrangement of exposing the cleat, for supporting on ice or the like, and covering the cleat, for supporting on a floor.

3 Claims, 2 Drawing Figures

CONVERTIBLE TIP FOR CRUTCH OR THE LIKE

This invention relates to a convertible tip for a crutch and a cane and a walker and like items for supporting the weight of a person, and the tip is convertible between a condition presenting a cleat member for penetrating ice or the like, for secure footing, and a condition of covering the cleat and even removing the cleat, so that a rubberized or cushioned member can be presented to the floor.

BACKGROUND OF THE INVENTION

The prior art already contains disclosures of crutch tips and the like which present toothed members or cleats for engaging ice or other penetrable surfaces, for secure positioning of the crutch on the surface. Examples of such toothed or cleat members are seen in U.S. Pat. Nos. 619,235 and 2,116,941. Also, the prior art is already aware of arrangements for crutch tips wherein cushioned or elastomeric members are positioned on the end of the crutch for protecting the surface on which the crutch rests and for assuring optimum frictional contact with the surface to avoid slipping. Examples of such prior art are found in U.S. Pat. Nos. 1,132,119 and 1,314,193.

However, the prior art crutch tips which are arranged for the purposes mentioned above are complicated and expensive arrangements and they require special machining or configurations of the crutch itself in order to receive and accomodate the tips mentioned. Still further, the prior art does not contain examples of a convertible type of crutch tip which can be arranged for readily and easily presenting a cleat member and which can be converted to either covering or removing the cleat member when it is no longer desired. Accordingly, the accomplishment of this objective is the primary purpose of this invention. That is, the present invention provides a convertible crutch tip which can be readily and easily arranged to present a cleat member and which be arranged to either cover the cleat member or to remove the cleat member, all with inexpensive but efficiently and reliably arranged components.

More specifically, it is an object of this invention to provide a convertible crutch tip which can be readily arranged to attach and present a cleat member, for engaging ice or the like, and the cleat member can be readily and easily covered with a protectable cup-shaped member, for temporary enclosure and covering of the cleat member, or the cleat member can be readily and easily removed from the tip, and therefore the user can readily and easily make either conversion required or desired.

Still further, it is the primary object of this invention to provide a convertible crutch tip which does not require that the crutch pull itself receive any attached piece or that the pole be shaped or machined in any particular way, in order for the pole to accomodate and receive the convertible attachment of this invention. Accordingly, the convertible tip of this invention is universally adaptable to any and all crutch poles without requiring any special cutting or shaping of the pole itself and therefore the tip can be applied to already existing poles and can be applied by the person in a matter of only a very few seconds.

Other objects and advantages will become apparent upon reading the following description in light of the accompanying drawings.

DETAILED DESCRIPTION OF THE PREFERRED EMBODIMENT

Figure 1:
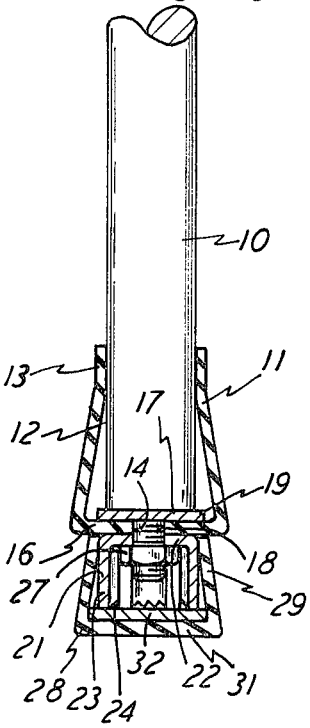
FIG. 1 is an elevational view of a convertible crutch tip of this invention, and showing parts thereof in section.

The convertible tip of this invention can be readily and easily applied to a crutch or a cane or a walker or any of the already existing and well-known types of supports for persons needing support for their legs, in the usual and well-known manner. Thus, FIG. 1 shows a pole 10 which has an elastomeric cup-shaped member 11 snugly and frictionally tightly disposed on the pole lower end 12, such that the cup-shaped member 11 is generally cylindrically shaped and has its cylindrical upper end 13 slightly stretched and therefore in snug contact with the circumference of the pole 10, as shown. That is, the member 11 may be the usual and standard type of foot or cup-shaped member commonly utilized with supports which are already in use today. The present invention arranges the member 11 with an opening 14 in its bottom or base portion 16, and a fastener 17 has its shank 18 extending through the opening 14, and it also has a circular and flat head 19 interposed between the pole 10 and the bottom portion 16, as shown. With this arrangement, the usual cupshaped member 11 only needs a small hole 14 formed therein, and the bolt-like fastener member 17 can then have its shank 18 penetrate the opening 14 and extend therethrough as shown.

A cup-shaped cleat member 21 is positioned below the member 11 and is in a position inverted therefrom, as shown, and the cleat member 21 may be of a rigid material, such as metal or the like. The cleat member 21 includes an intermediate base portion 22 and the cylindrical side walls 23, and the two cup-shaped members 11 and 21 are shown disposed in base portion-to-base portion abutting position. Also, the lower edge of the cleat member 21 has teeth 24 which project axially of the pole 10 and downwardly therefrom, as shown, and thus the teeth 24 are shown spaced around the cylindrical side walls 23 and are available for engaging ice, hard ground, or other penetrable surfaces on which the support may be used and it is therefore desired that film support be obtained by virtue of the teeth 24 penetrating the supporting surface. The cleat member 21 has a central opening 26 which receives the fastener shank 18, and a nut 27 is secured on the shank 18 to clamp the cleat member 21 to the member 11, and thus to secure the cleat member 21 with the pole 10. Of course, the cleat member 21 and the releasable fastener 17 can be readily removed from the member 11, simply by slipping the member 11 off the pole 10 and removing the fastener 17 and the member 21 from the cup-shaped member 11.

When it is desired that the cleat member 21 not be available for use, such as when the crutch is being used on floor or other finished surface, then the cleat member 21 can either be removed from the member 11, as just described, or there can be another elastomeric cup-shaped member 28 which is of a cylindrically shaped body portion 29 for snugly sliding over the cup-shaped member 21, to the position shown in FIG. 1. Thus the member 28 presents a bottom portion 31 which covers the teeth 24 and thus protects the floor. Also, there may be a metal washer 32 interposed between the cup-shaped member 28 and the teeth 24 for protecting the member 28 from the teeth 24 and, as such, the user can then use the crutch on the floor when the cup-shaped member 28 is applied as shown in FIG. 1.

Figure 2:
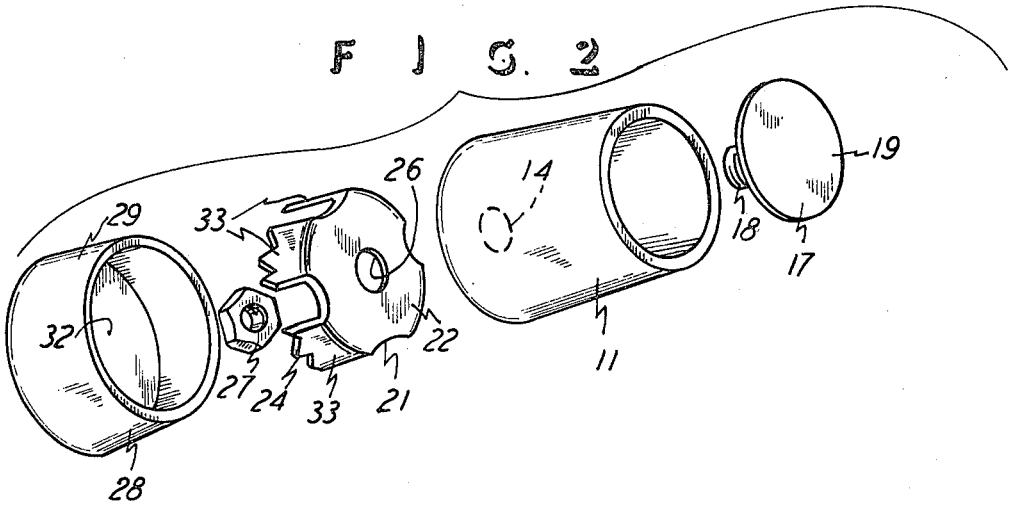
FIG. 2 is an exploded perspective view of the crutch tip parts of FIG. 1 on a slightly enlarged scale.

FIG. 2 of course shows the various parts of the convertible tip in the exploded perspective view, and thus the construction and configuration of the parts should be apparent from these drawings. Also, it will be seen that the cleat member 21 can be readily made by stamping an originally flat piece of metal, and one skilled in the art will readily see that the metal can be stamped to present the four leg portions 33 and to present the central opening 26 in the member 21. Next, the legs 33 can be bent to their right angled position relative to the portion 22, and thus the cleat member 21 is readily and easily manufactured and is sturdy in its arrangement and will not tend to collect ice or snow or the like but the spaced-apart legs 33 will permit the removal of any foreign matter from the interior of the piece 21. Also, the members 11 and 28 may be made of a rubber or plastic material which is stretchable and resilient, and, as such, they can be positioned frictionally tight and in a snugly stretched position on the pole 10 and on the cleat member 10, respectively, for remaining thereon until being pulled therefrom as described. Also, with the resilient portion 16 of the member 11 interposed between the pole 10 and the cleat member 21, the cleat member 21 is actually cushioned by the member 11 and it also can assume an angle, of some small degree, for biting into the ice or hard surface and that is when the cleat member 21 would slightly tip relative to the axis of the pole 10, as will be apparent to one skilled in the art.

What is claimed is:

1. A convertible tip for a crutch, pole, and the like, comprising an elastomeric cup-shaped member adapted to be disposed on the end of said pole for encircling the latter to be available for contacting the ground during the use of supporting a person, a cylindrical cup-shaped cleat member having teeth spaced around the edge of the cylinder thereof for engaging the ground when in position on said cup-shaped member, the aforesaid cup-shaped members both including base portions and being disposed in base portion-to-base portion abutting position, a releasable fastener extending through said base portions of the aforesaid cup-shaped members for co-axially removably attaching said cleat member to said elastomeric cup-shaped member, and a second elastomeric cup-shaped member snugly disposed on said cleat member and being frictionally held thereto by virtue of the elastomeric stretch over said cleat member and covering said teeth to prevent engagement of a floor by said teeth and said second elastomeric cup-shaped member being removable from said cleat member to permit engagement of the floor by said teeth.

2. The convertible tip as claimed in claim 1, including a rigid washer disposed in said second elastomeric cup-shaped member and in abutment with said teeth for protecting said second elastomeric cup-shaped member from said teeth.

3. The convertible tip as claimed in claim 1, wherein said releasable fastener is a flat-headed bolt with the head thereof disposed inside the first said elastomeric cup-shaped member and with the shank of said bolt extending into said cleat member.

* * * * *